United States Patent [19]

Desourdy

[11] Patent Number: 4,655,402

[45] Date of Patent: Apr. 7, 1987

[54] PORTABLE CRUSHING PLANT

[76] Inventor: Bernard Desourdy, 545 de Normandie Street, Longueuil, Canada, J4H 3P6

[21] Appl. No.: 334,305

[22] Filed: Dec. 24, 1981

[51] Int. Cl.[4] ..... B02C 21/02

[52] U.S. Cl. ..... 241/76; 241/101.7

[58] Field of Search ..... 241/101.7, 79.1, 79, 241/76, 80, 97

[56] References Cited

U.S. PATENT DOCUMENTS

| | | |
|---|---|---|
| Re. 28,125 | 4/1966 | Quinn . |
| 3,226,043 | 12/1965 | Bowman . |
| 3,563,477 | 2/1971 | Schruexer . |
| 3,670,972 | 6/1972 | Quinn . |
| 4,168,034 | 9/1979 | Leger . |

FOREIGN PATENT DOCUMENTS

| | | |
|---|---|---|
| 688077 | 6/1964 | Canada . |
| 845700 | 6/1970 | Canada . |
| 937915 | 12/1973 | Canada . |
| 1042404 | 11/1978 | Canada . |
| 1042406 | 11/1978 | Canada . |

*Primary Examiner*—Mark Rosenbaum

[57] ABSTRACT

A portable plant to crush stones characterized by its simple construction and operation, good capacity of production, convenient control by a single operator in a centrally located cabin, and collapsible main components for convenient transportation. This portable crushing plant comprises a main truck and auxiliary trucks, conveyors mounted on the main truck, crushing units and screening units mounted on the auxiliary trucks respectively, and the conveyors and screening units being collapsible for convenient transportation thereof.

3 Claims, 15 Drawing Figures

38
39
40
22
28
24b
27
30
21
10
24
24a
29
26
35
23

PORTABLE CRUSHING PLANT

FIELD OF THE INVENTION

This invention relates to a stone crushing plant of the type that is portable or transported to the site to provide on the spot crushing of stones.

DESCRIPTION OF THE PRIOR ART

The advantages of portable stone crushing plants are well recognized and put to contribution. The plants of the above type that have been produced and used so far include the basic components, crushing and screening units and conveyors, mounted in mixed combination on a single truck. There results rather complex and low capacity plants due to the small area available on a single truck.

SUMMARY OF THE INVENTION

It is a general object of the present invention to provide a portable crushing plant that is mounted on a plurality of trucks to provide a larger size and more productive plant.

It is another object of the present invention to provide a portable crushing plant of the above type that is mounted on a plurality of trucks to allow a simpler construction and operation.

It is a further object of the present invention to provide a portable crushing plant of the above type that includes a control cabin that is centrally and conveniently located to allow control by a single controller.

It is still another object of the present invention to provide a portable crushing plant in which major components are collapsible to a stowage position for transportation.

BRIEF DESCRIPTION OF THE DRAWINGS

The above and other objects and advantages of the present invention will be better understood with reference to the following detailed description of a preferred embodiment thereof which is illustrated, by way of example, in the accompanying drawings; in which.

Figures 1, 2:
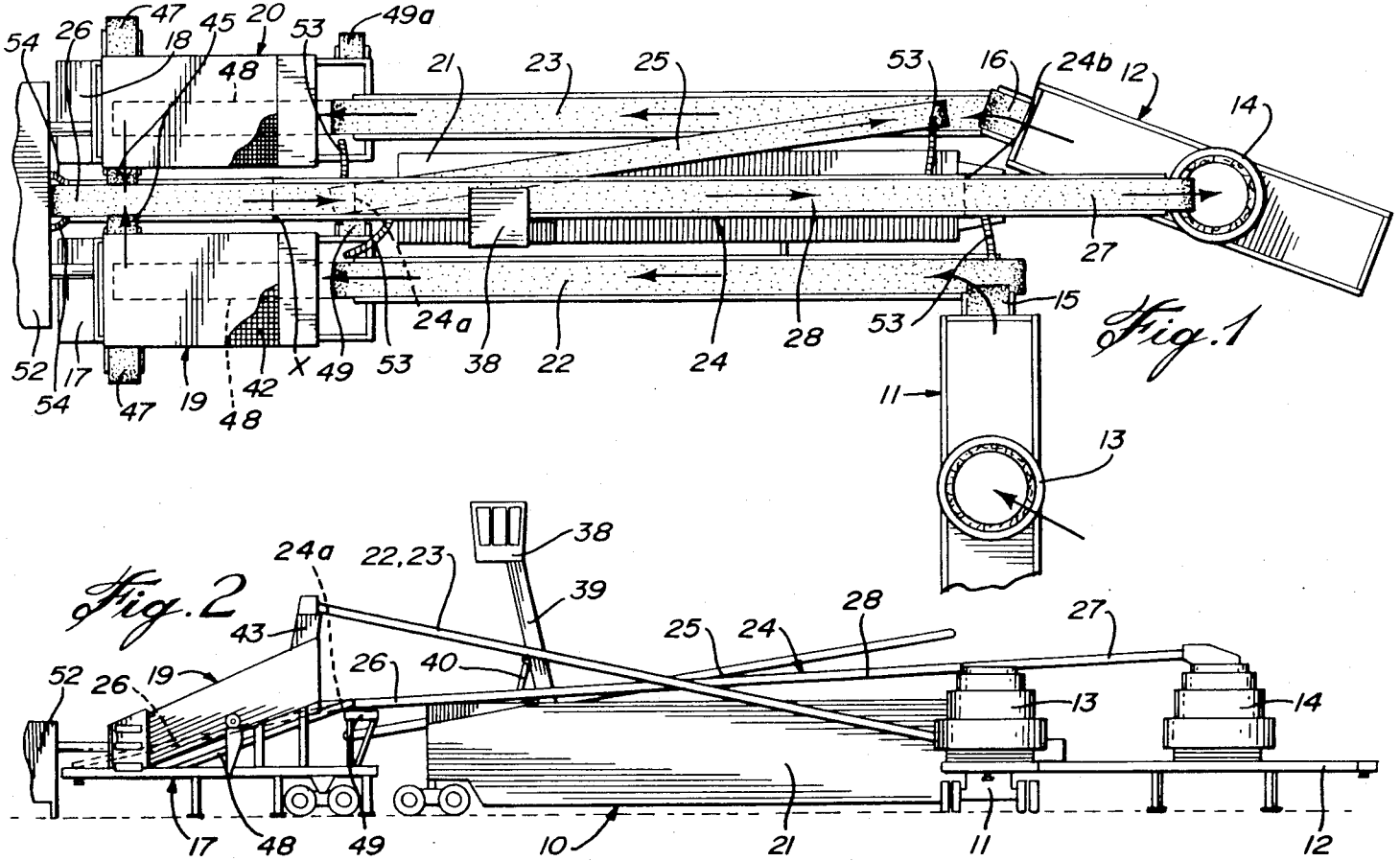
FIG. 1 is a top plan view of a portable crushing plant according to the present invention.
FIG. 2 is a side elevation view of the portable crushing plant of FIG. 1.

The illustrated portable crushing plant comprises a main truck 10 particularly provided to carry controls for the overall plant and conveyors for the crushed stones. The portable crushing plant also includes a pair of auxiliary trucks 11 and 12 carrying a pair of conventional crushing units 13 and 14 respectively. These crushing units are positioned at one end of the main truck and are provided with endless conveyors 15 and 16 respectively to convey the crushed stones toward the conveyors on the main truck.

The portable crushing plant also includes another pair of auxiliary trucks 17 and 18 positioned at the other end of the main truck 10 and carrying a pair of stone screening units 19 and 20 respectively.

Figures 3, 4:
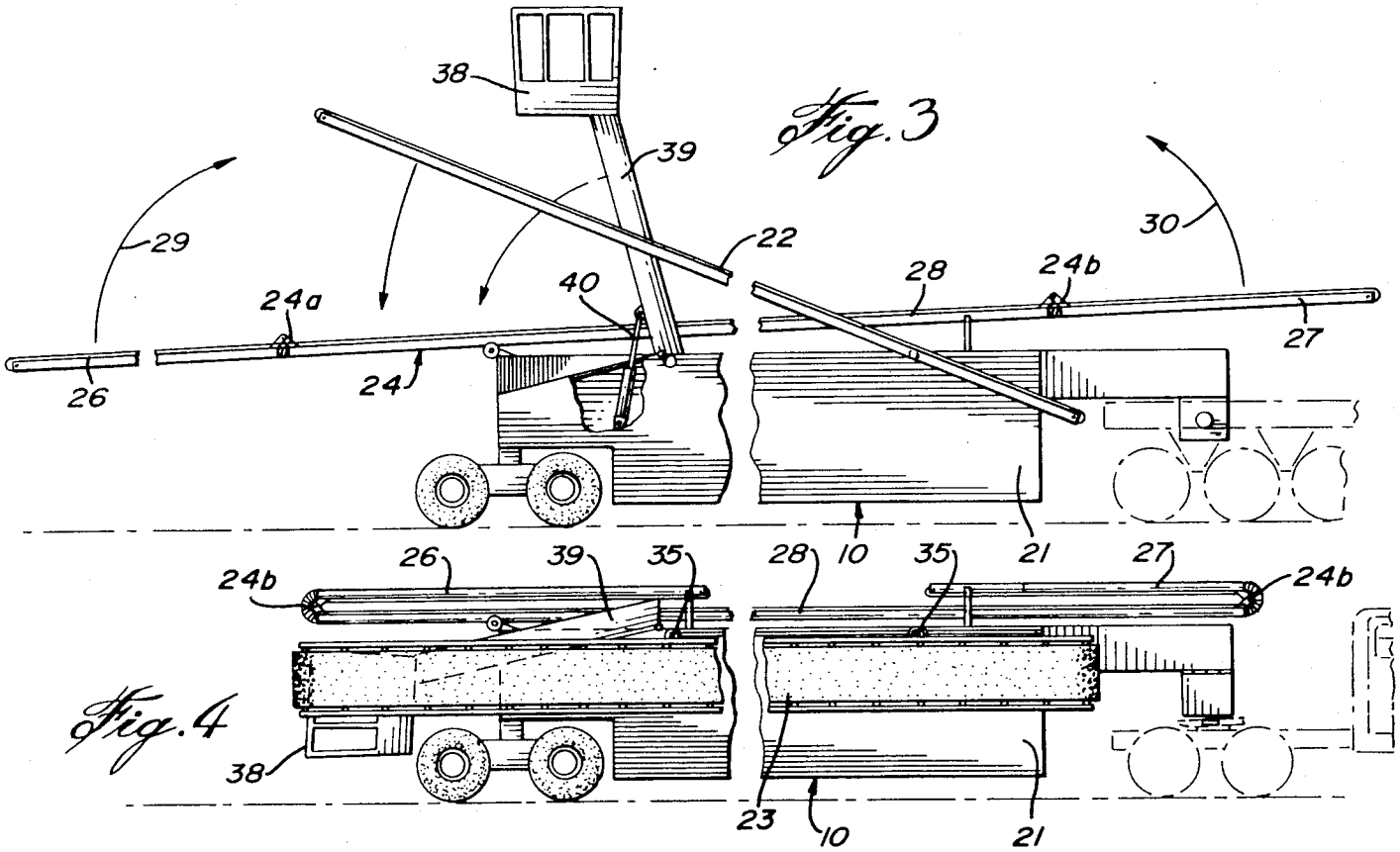
FIGS. 3 and 4 are side elevation views of a main truck carrying conveyors in extended and collapsed positions respectively.
Figure 5:
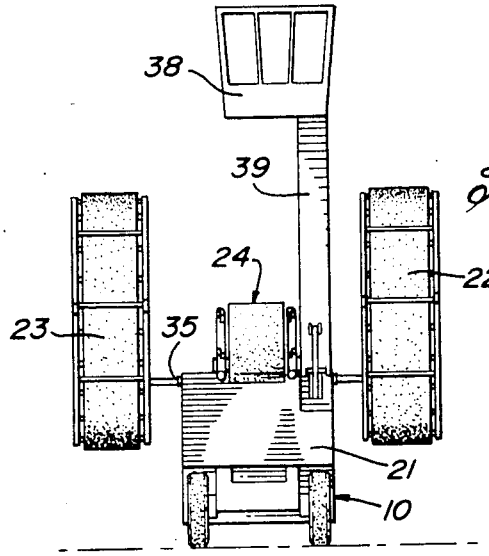
FIG. 5 is an end view of the main truck as seen from the left in FIG. 3.
Figure 6:
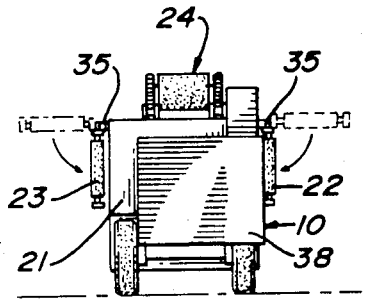
FIG. 6 is an end view of the main truck as seen from the left in FIG. 4.
Figure 7:
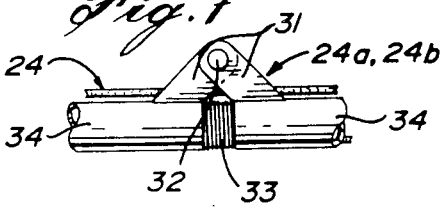
FIGS. 7 and 8 are side views of a pivotal joint between cooperating conveyor sections and shown in operative and collapsed positions respectively.
Figure 8:
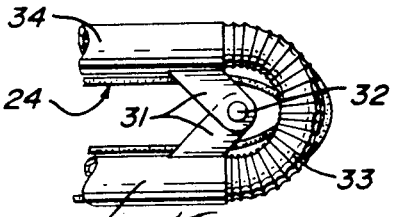
Figure 9:
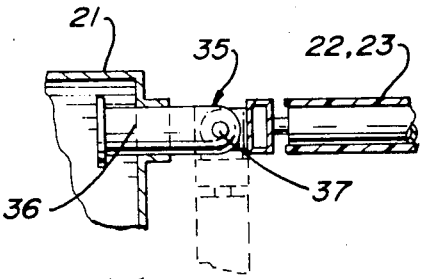
FIGS. 9 and 10 are side and top views respectively of a pivotal joint between a laterally collapsible conveyor and the body of the main truck.
Figure 10:
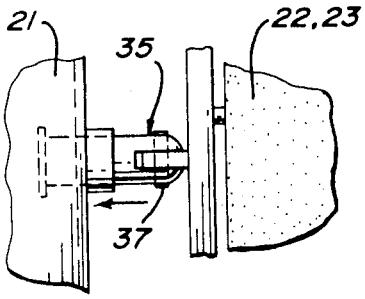

The main truck 10 carries an elongated box 21 to house controls and drive components for the conveyors, the crushing units 13, 14 and the screening units 19, 20. The box 21 also houses dust collecting components. Main truck 10 forms a conveyor carrying unit and its box 21 has side walls, a top wall and end walls. The trucks 10, 11, 12, 17, and 18 are preferably truck trailers of any appropriate construction. The conveyors mounted on the main truck 10 include a pair of lateral conveyors 22, 23 and a pair of intermediate belt conveyors 24 and 25 each extending lengthwise longitudinally of the main truck 10. Each of these conveyors is pivotable in the fore and aft direction between its operatively inclined position, as shown in FIG. 2, and its collapsed transport position, as shown in FIG. 4. This pivoting of the conveyors is done through hydraulic or pneumatic cylinders projecting from the box 21. The lateral conveyors 22, 23 extend from under the outer end of the conveyors 15, 16 to a higher position to discharge crushed stone materials onto the screening units 19 and 20 respectively. The intermediate conveyor 24 has opposite end portions 26 and 27 projecting at the opposite ends of the main truck and hinged to a corresponding intermediate portion 28 to be folded back over the latter into transport position as shown by the arrows 29, 30 in FIG. 3. Intermediate portion 28 is carried by and extends over the top wall of box 21. The hinges **24*a* and 24*b* between the conveyor portions 26, 27 and 28 are shown in FIGS. 7 and 8 and include brackets 31 fixedly secured at the adjoining ends of the conveyor portions and pivoted one to another by a transverse axis at 32. Flexible tubes 33 interconnect the adjoining ends of the tubular members 34 extending longitudinally of the conveyor 24 to provide a fluid channel running from end to end thereof to transmit dust cleaning vacuum along this conveyor. The lateral conveyors 22, 23 operatively project laterally on the opposite sides of the main truck 10 and are pivoted to the box 21 by hinges 35 to be placed in an operative position, as shown in FIG. 5 or in a transport position, as shown in FIG. 6. In the latter position, the conveyors 22, 23 hang flat against the opposite sides of the box 21 to reduce the effective width of the main truck 10 within legal road width limits. The hinge 35 includes a stud 36 slidable endwise through the corresponding side of the box 21 and pivotally attached at its outer end by an horizontal pin 37 to one side of the corresponding lateral conveyor 22 or 23. A control cabin 38 is fixed to the outer end of a mast 39 that is pivoted at its inner end to the box 21 about a transverse axis. An hydraulic cylinder 40 is connected to the mast 39 to pivot the latter and the control cabin between an elevated operative position, as shown in FIGS. 2 and 3, and a lowered transport position, as shown in FIG. 4**.

Figure 11:
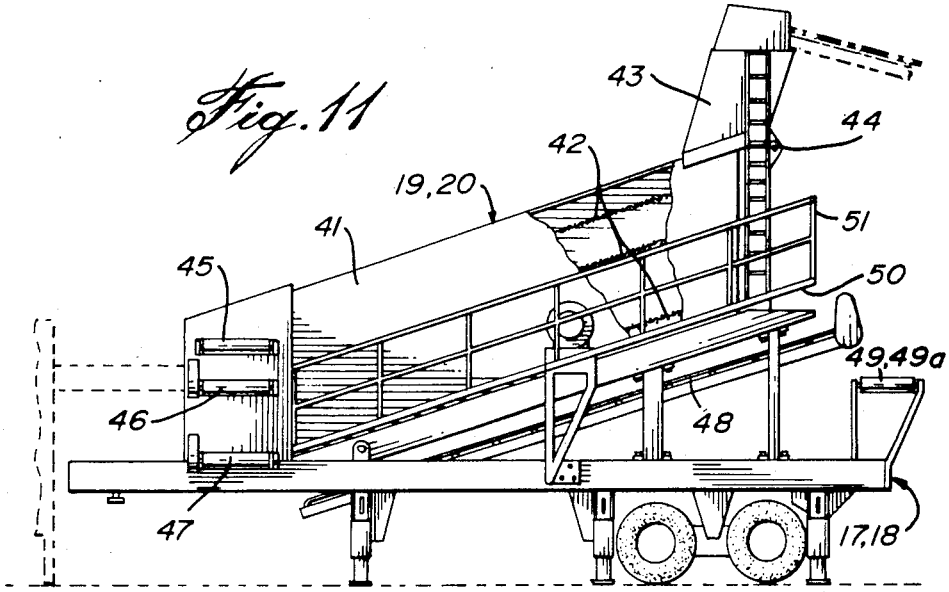
FIGS. 11 and 12 are side elevation views of a screen unit in operatively elevated position and downwardly collapsed positions respectively on the carrying truck.
Figure 12:
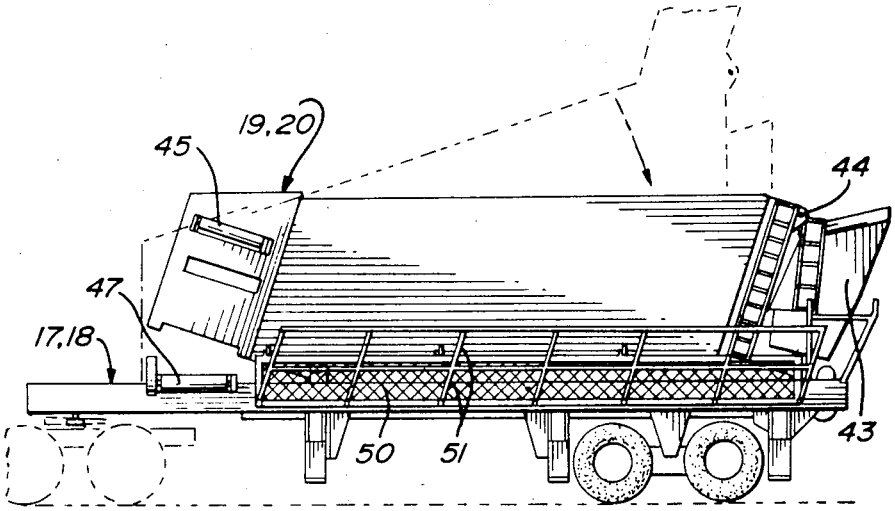
Figure 13:
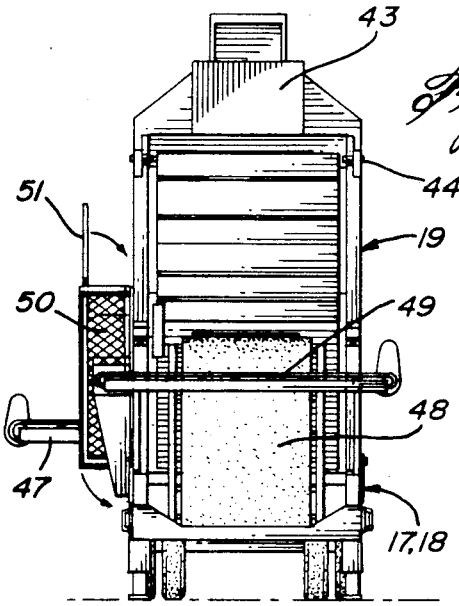
FIGS. 13 and 14 are end views of a screen unit and truck as seen from the right in FIGS. 11 and 12 respectively.
Figure 14:
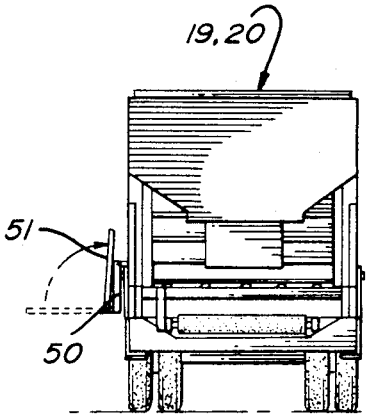
Figure 15:
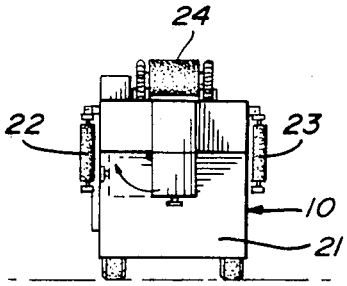
FIG. 15 is an end view of the main truck and conveyors thereon as seen from the right in FIG. 3.

Each of the screening units 19, 20 includes a housing 41 extending longitudinally of the corresponding auxiliary truck and pivoted relative to the latter between an elevated operative position, as shown in FIG. 11, and a lowered transportation position, as shown in FIG. 12. The housing 41 includes a series of superposed screens 42 of downwardly reducing mesh sizes. An inlet chute 43 is pivotally connected at 44 to the housing 41 to pivot between an operative inlet position and a transportation position. In the operative inlet position, as shown in FIG. 11, the inlet chute 43 rests onto the upper edges of the opposite sides of the housing 41 and overlies the upper end of the screens 42. In the inoperative transport position as shown in FIG. 12, the inlet chute is pivotally lowered at the rear of the housing 41. Transverse conveyors 45, 46, 47 are provided in conventional fashion at the lower end of the screens 42 to collect the stones that do not pass through the screens but rather roll down on them. The transverse conveyors 45, 46, discharge onto the intermediate conveyor 24 that feeds the crushing unit 14 with the crushed stones that are still too big. A conveyor 48 extends longitudinally under the screens 42 of each screening unit 19, 20 to pick up the crushed stones passing through the screens and feed them onto another transverse conveyor 49 and 49*a* respectively, one for each unit 19, 20. Conveyor 49 discharges onto the conveyor 25 from the screening unit 19 and conveyor 49*a* discharges outwardly to be used as such. The transverse conveyor 47 of each screening unit 19, 20 also discharges laterally off to provide crushed stone material of somewhat larger size compared to the crushed stone material coming off the transverse conveyor 49*a* of the screening unit 20. As shown in FIGS. 11, 12 and 13 for the screening unit 19, each screening unit 19, 20 includes a gangway along one side and made of a board 50 and rail 51 that are pivoted to the housing 41 and to each other to be laterally collapsible as shown in FIGS. 12 and 14.

As can be understood quite clearly from the arrows in FIG. 1, the uncrushed stones are dropped in the first-stage crusher 13 from where it leaves at the bottom onto the conveyor 15 as crushed stone elements of varying sizes. Those elements are fed by the conveyor 15 onto the conveyor 22 and by the latter onto the screens 42 of screening unit 19. The smallest crushed stone elements fall right through all the superposed screens 42 onto the underlying conveyor 48 that discharges onto the transverse conveyor 49. The latter in turn discharges those smallest elements onto the conveyor 25 and the latter onto conveyor 23, thus bypassing the second crushing stage provided by the crusher 14. Crushed stone elements of somewhat larger mesh size fall on the conveyor 47 of each unit 19, 20 to be outwardly discharged and be used as such. The largest crushed stone elements drop from the screens 42 of the screening units 19 and 20 on the corresponding transverse conveyors 45, 46 that discharge onto the conveyor 24 to be fed into the crusher 14 for a second stage of crushing. That crusher 14 discharges the resulting crushed stone elements onto the conveyor 16 to transport the same by the conveyor 23 to the screening unit 20 where they are screened again as in the screening unit 19.

A bag filter unit 52 of known construction is operatively connected by flexible tubes 54 to the portable crushing plant and in particular to the tubes 34 and flexible branch tubes 53 to suck the dust and produce better environmental conditions around the plant.

What I claim is:

1. In a portable crushing plant including a primary crushing unit, a secondary crushing unit, a pair of screening units, and a conveyor-carrying unit, each mounted on wheels and roadable independently of each other, each crushing unit and each screening unit having a higher level material inlet and a lower level material outlet, said conveyor-carrying unit comprising a wheel-mounted elongated horizontal box having side walls, first and second end walls and a top wall, a first straight belt conveyor for carrying crushed material, consisting of an intermediate section and of first and second end sections, said intermediate section being carried by said top wall, longitudinally and horizontally over the same, said first and second end sections pivotally connected to the respective ends of said intermediate section for pivotal movement in a vertical plane between an operative position, each forming an extension of said intermediate section and projecting beyond the respective end walls of said box, and a collapsed inoperative position overlying said intermediate section, and second and third belt conveyors pivotally attached to the side walls of said box for pivotal movement between a collapsed inoperative position extending longitudinally flat against said side walls and an operative position projecting from said side walls in transverse horizontal position and longitudinally upwardly inclined from said first to said second end wall of said box, said second and third belt conveyors, when in operative position, having their lower inlet ends adapted to receive material from the outlet of the respective crushing units operatively positioned adjacent said first end wall of said box, and having their upper outlet ends adapted to discharge material from the respective crushing units into the inlets of the respective screening units operatively positioned in side-by-side relation adjacent said second end wall of said box, and said first conveyor belt, when in operative position, having its inlet end adapted to receive material discharged from the lower outlet of both screening units and having its outlet end adapted to discharge material into the inlet of said secondary crushing unit.

2. In a portable crushing plant as defined in claim 1, further including a mast having a lower end pivoted at the top of said box about an axis transverse to said box, and a control operator housing cabin carried by the top of said mast, said mast and cabin vertically pivotable about said axis between an upright operative position with said cabin spaced above said conveyors and a collapsed position along and over said top wall.

3. In a portable crushing plant as claimed in claims 1 or 2, further including a rigid tube extending along said first belt conveyor and having flexible joints at the pivotal connections of said intermediate section to said end section, one end of said tube adapted to be connected to a bag filter unit and flexible branch tubes connected to said rigid tube and having air-sucking ends disposed at the inlet and outlet ends of said conveyors to suck dust produced at said ends.

* * * * *